US005969590A

United States Patent [19]

Gutierrez

[11] Patent Number: 5,969,590

[45] Date of Patent: Oct. 19, 1999

[54] INTEGRATED CIRCUIT TRANSFORMER WITH INDUCTOR-SUBSTRATE ISOLATION

[75] Inventor: German R. Gutierrez, Carlsbad, Calif.

[73] Assignee: Applied Micro Circuits Corporation, San Diego, Calif.

[21] Appl. No.: 08/910,456

[22] Filed: Aug. 5, 1997

[51] Int. Cl.[6] ..... H01F 5/00; H01F 27/28

[52] U.S. Cl. ..... 336/200; 336/232; 336/223

[58] Field of Search ..... 336/200, 223, 336/232, 102

[56] References Cited

U.S. PATENT DOCUMENTS 4,959,631 9/1990 Hasegawa et al. ..... 336/83
5,420,558 5/1995 Ito et al. ..... 336/200
5,481,131 1/1996 Staudinger et al. ..... 257/531

OTHER PUBLICATIONS

Yannis Tsividis, "Mixed Analog–Digital VLSI Devices and Technology", McGraw–Hill, pp. 168–170, 1996.

*Primary Examiner*—Michael L. Gellner
*Assistant Examiner*—Anh Mai
*Attorney, Agent, or Firm*—Gray Cary Ware Freidenrich

[57] ABSTRACT

An integrated circuit transformer includes multiple metal layers in the structure of an integrated circuit in which are formed a first spiral inductor and a second spiral inductor. The first spiral inductor is aligned with and beneath the second spiral inductor such that the first spiral inductor acts to magnetically excite the second spiral inductor, while shielding it from resistance losses to the substrate.

10 Claims, 5 Drawing Sheets

INTEGRATED CIRCUIT TRANSFORMER WITH INDUCTOR-SUBSTRATE ISOLATION

CROSS REFERENCE TO RELATED APPLICATIONS

This application contains material related to co-pending, commonly-assigned, U.S. patent Application Ser. No. 08/856,259, filed May 14, 1997, for "LC OSCILLATOR WITH DELAY TUNING", inventor G. Gutierrez.

BACKGROUND OF THE INVENTION

1. Field of the Invention

The invention concerns an integrated circuit transformer including two or more inductors in which at least one inductor of the transformer is isolated from the integrated circuit substrate and driven by a second inductor of the transformer.

It is possible to design and build an integrated electronic circuit (IC) that includes reactive elements that are fully integrated, structurally and functionally, with other components of the IC. In this regard, the design and manufacture of IC capacitors are well established. However, the size and performance of fully integrated inductors are quite limited, and monolithic inductors typically exhibit significant values of resistance and loss. Consequently, integrated reactive circuits such as LC resonators exhibit low values of quality (Q), typically in the range of $1<Q<10$. The low quality of integrated LC resonators is due to resistive losses in the inductor metal and to the silicon substrate that underlies the inductor. Reduction of resistive losses to the substrate should enable an increase in the Q of an integrated LC resonator.

SUMMARY OF THE INVENTION

The invention is embodied in an integrated circuit transformer built out of at least two metallic material layers in which a first metallic inductor is disposed in a predetermined pattern in a first material layer of an integrated circuit and a second metallic inductor is disposed in the same pattern, over the first metallic inductor, in a second material layer. The patterns of the first and second metallic inductors are substantially aligned with respect to each other, over the substrate. In this configuration, the second metallic inductor is isolated from the substrate by the first metallic inductor. When connected for transformer operation, the first metallic inductor acts as a driver of the second metallic inductor. Advantageously, the first metallic inductor can comprise two inductors to provide a transformer with two secondary coils. A resonator may be built by adding a capacitor in parallel to the second metallic inductor. Since the first and second metallic inductors operate in synchronism, the first metallic inductor does not itself present a load to the second metallic inductor, as would happen if a metal plane were placed between the second metallic inductor and the substrate.

It is therefore one objective of this invention to provide an integrated circuit transformer that includes at least two metallic inductors in which a first metallic inductor acts a shield between the second metallic inductor and a substrate of the integrated circuit.

Another objective is to use a multi-level metal process in the manufacture of an integrated circuit transformer including two or more spiral inductors that are stacked and aligned vertically with respect to the integrated circuit substrate.

Yet another objective is to provide an integrated circuit transformer that includes a spiral metallic inductor disposed over and in alignment with one or more spiral metallic inductors such that the bottom metallic inductors act to both shield the top metallic inductor from substrate losses and to excite a waveform on it.

The achievement of these and other objectives and advantages of this invention will be understood with reference to the below-described drawings.

DETAILED DESCRIPTION OF THE PREFERRED EMBODIMENTS

Figure 1:
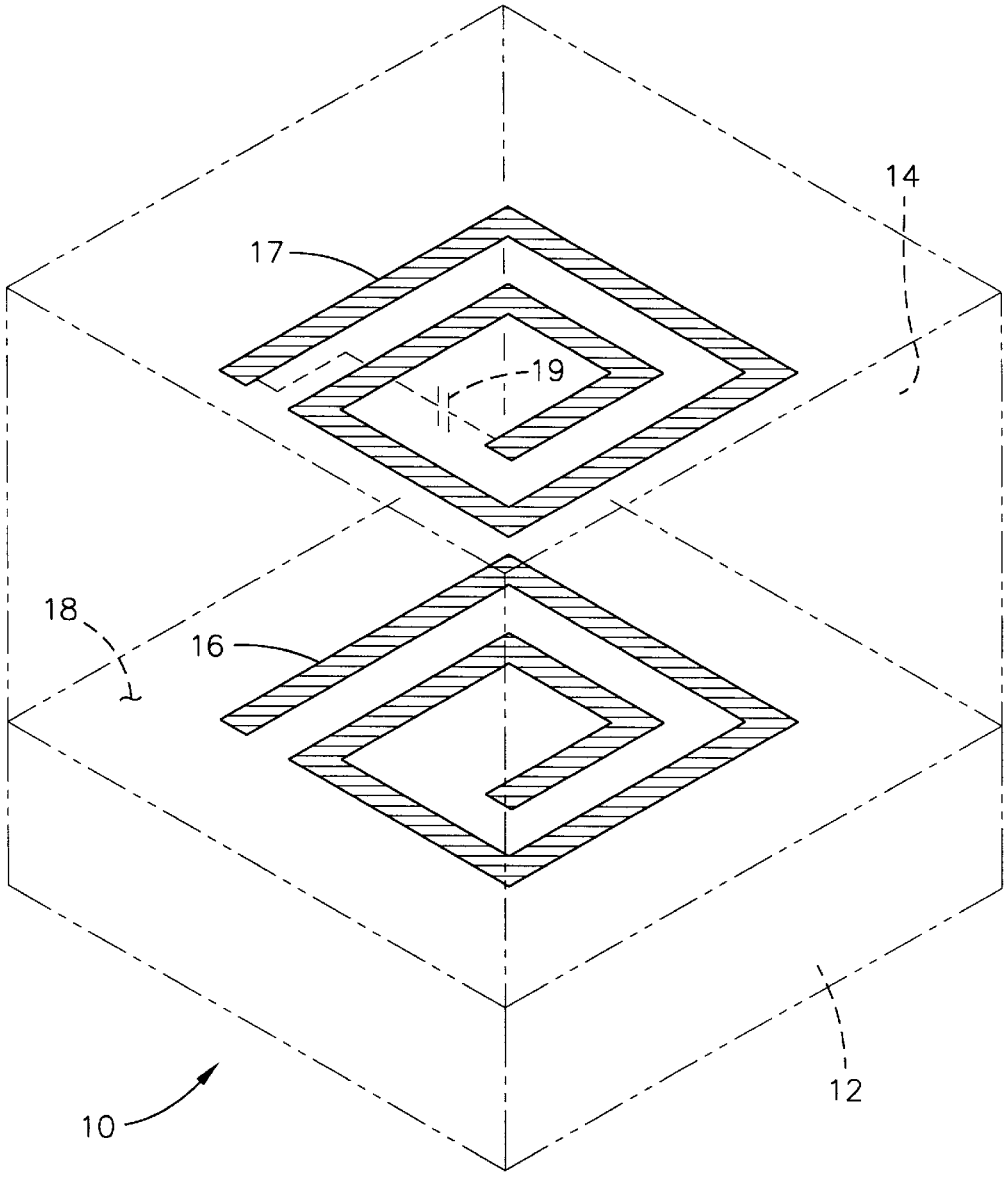
FIG. 1 is perspective view through a cubic section of an integrated circuit showing the disposition of two metallic inductors with respect to each other and to the substrate of the integrated circuit.

Refer now to FIGS. 1–6 in which like reference numerals indicate the same elements throughout the figures. FIGS. 1–6 illustrate an integrated circuit transformer that includes two or more metallic inductors disposed in a monolithic integrated circuit such that a first inductor (the "bottom inductor") is vertically aligned with a second inductor (the "top inductor") with respect to an IC substrate, and in which the bottom inductor both shields and drives the top inductor.

In following description, integrated circuit (IC) manufacturing steps are described with enough detail to show relationships between circuit elements of completed integrated circuits. Many fabrication details are omitted from this description, with the understanding that those skilled in the art may employ as many of those details as are called for in any particular design. Moreover, when description is given in this application of IC fabrication steps, those skilled in the art will realize that each such step may actually comprise one or more discrete steps and that other steps, not described herein, may be necessary to achieve specific applications of the invention. For a detailed explanation of the fabrication of ICs that combine analog and digital components, reference is given to MIXED ANALOG-DIGITAL VLSI DEVICES AND TECHNOLOGY by Y. Tsividis, McGraw-Hill, New York, 1996.

Referring now to FIG. 1, there is shown a cubic section 10 of a monolithic integrated circuit (IC) that includes a substrate material layer 12 over which are fabricated a multiplicity of material layers forming electronic elements that are connected in predetermined ways so that they operate together as one or more electronic circuits. Material volume 14 represents these layers. Disposed as discrete material layers within the volume 14 are two layers of metallic material, each formed into a characteristic pattern of deposited metal. These layers are occupied by metallic inductors 16 and 17. Since the material volume 14 is built in a sequence of layers that ascend vertically from and upper surface 18 of the substrate material layer 12, the metal layer in which the metallic inductor 16 is formed is disposed beneath the layer in which the metallic inductor 17 is formed, when the volume section 10 is oriented as illustrated in FIG. 1.

In FIG. 1 each of the metallic inductors 16 and 17 has a characteristic shape that, as the skilled artisan will realize, corresponds to the shape of a spiral inductor. More precisely, since the metal inductor 16 is formed in a material layer that is deposited before the material layer in which the metallic inductor 17 is formed, the metallic inductor 16 may be denominated the "first" metallic inductor, while the metallic inductor 17 may be denominated the "second" metallic inductor. Alternatively, metallic inductor 16 may be denominated the "lower" or "bottom" metallic inductor while the metallic inductor 17 may be denominated as the "upper" or "top" metallic inductor.

As shown in FIG. 1, the parts of metallic inductors 16 and 17 have the same line widths and lengths and are aligned with respect to each other, over the surface 18 of the substrate material layer 12 so that, when viewed in plan from above the surface 18, only the upper metallic inductor 17 can be seen.

The elements 16 and 17 that are illustrated in FIG. 1 are denominated as "inductors" since they are elements that store energy in response to a flow of current. Disposed as they are in the integrated circuit from which the cubic section 10 is taken, a magnetic field induced in the lower metallic inductor 16 by a current flowing therethrough will be coupled to the upper metallic inductor 17, inducing a current therein, so that the lower and upper metallic inductors 16 and 17 operate as a transformer, with the lower metallic inductor 16 serving as the primary coil. Further, the position of the lower metallic inductor 16 between the upper metallic inductor 17 and the substrate material layer 12 causes the lower metallic inductor 16 to isolate the upper metallic inductor 17 from the substrate material layer 12, thereby reducing, if not eliminating, the resistance that is normally modelled between the upper metallic inductor 17 and the substrate material layer 12.

Figure 2B:
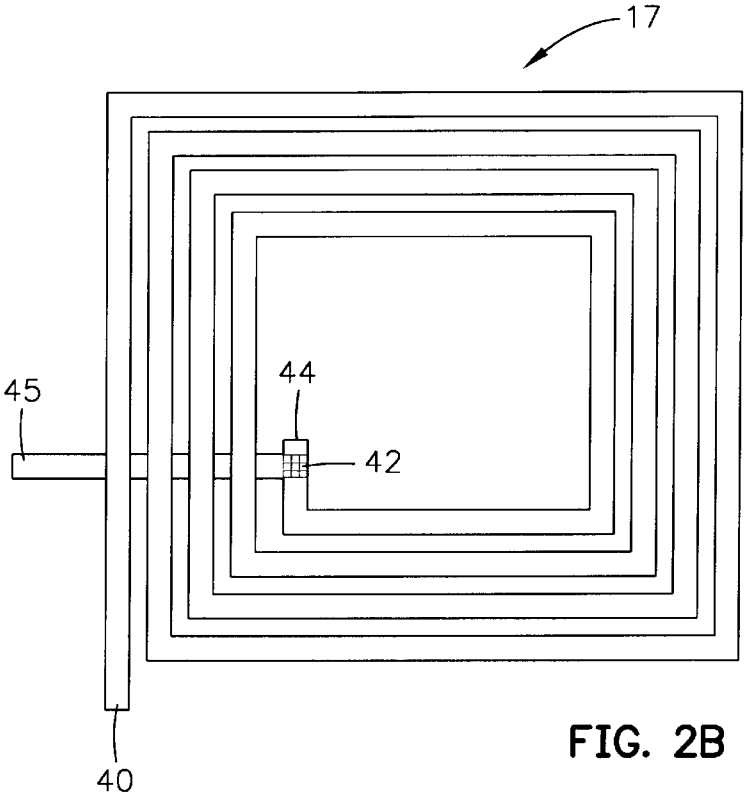
FIGS. 2A and 2B are, respectively, layout plots that show patterns and connections of a first metallic inductor and a second metallic inductor, respectively, for an integrated circuit transformer according to this invention.
Figure 2A:
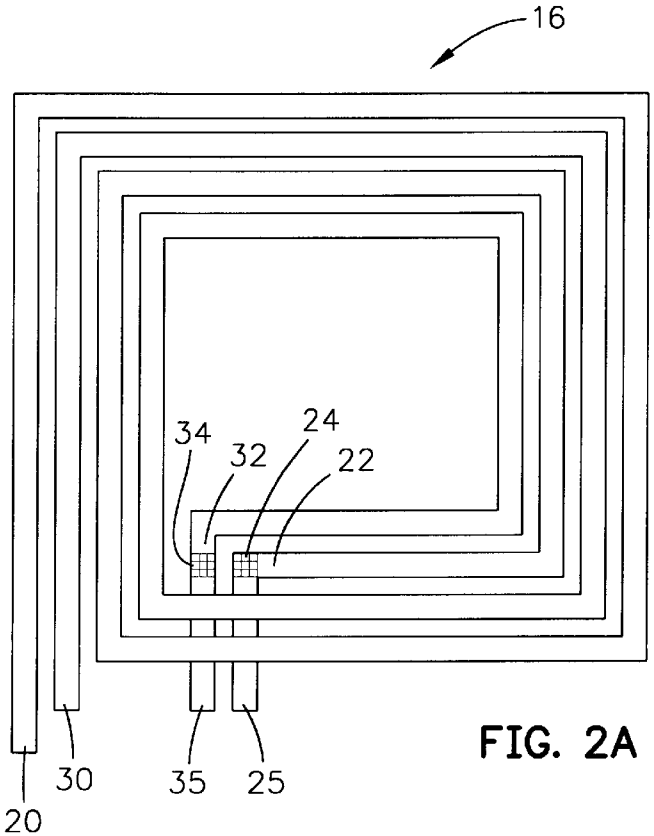

Representative patterns and connections of the lower and upper metallic inductors 16 and 17 are illustrated in FIGS. 2A and 2B, respectively. In this regard, the lower metallic inductor 16 includes a square spiral having a first terminal 20 and a second terminal 22. The entire trace of the square spiral between terminals 20 and 22 is disposed within one metal layer, referred to hereinafter as "metal 2". A metallic strip 25 in a metal layer beneath metal 2 is brought into electrical contact with the terminal 22 by way of a via 24. In this description, the metal layer in which metallic strip 25 is formed is referred to as "metal 1". The via 24 extends between metal 1 and metal 2, through one or more intervening layers of IC material. If desired for design considerations, the lower metallic inductor 16 may comprise two separate inductors, the first having already been described. The second of the two metallic inductors includes metallic inductor with a spiral shape that is formed in metal 2, the same layer in which the first inductor is formed. This second inductor includes a first terminal 30 and a second terminal 32. All of the structure between the terminal 30 and the terminal 32 is contained in metal 2. A metallic strip 35 formed adjacent the metallic strip 25 in metal 1 is connected to the terminal 32 by a via 34.

If design considerations support the desirability of the multiple-inductor configuration shown in FIG. 2A, it should be noted that, with the phases of the currents being substantially identical at the terminals 20 and 30, the fields generated in the multiple inductors are mutually reinforcing.

The second metallic inductor 17, illustrated in FIG. 2B has substantially the same pattern, with the same number of turns, and the same line lengths and widths, as the first metallic inductor 16. Further, the portion of the metallic inductor 17 between a first terminal 40 and a second terminal 42 is formed in a third metal layer (metal 3). The terminal 42 is connected by way of a via 44 to a metallic strip 45 that is formed in metal 1, the same layer in which the strips 25 and 35 are formed.

Figure 3:
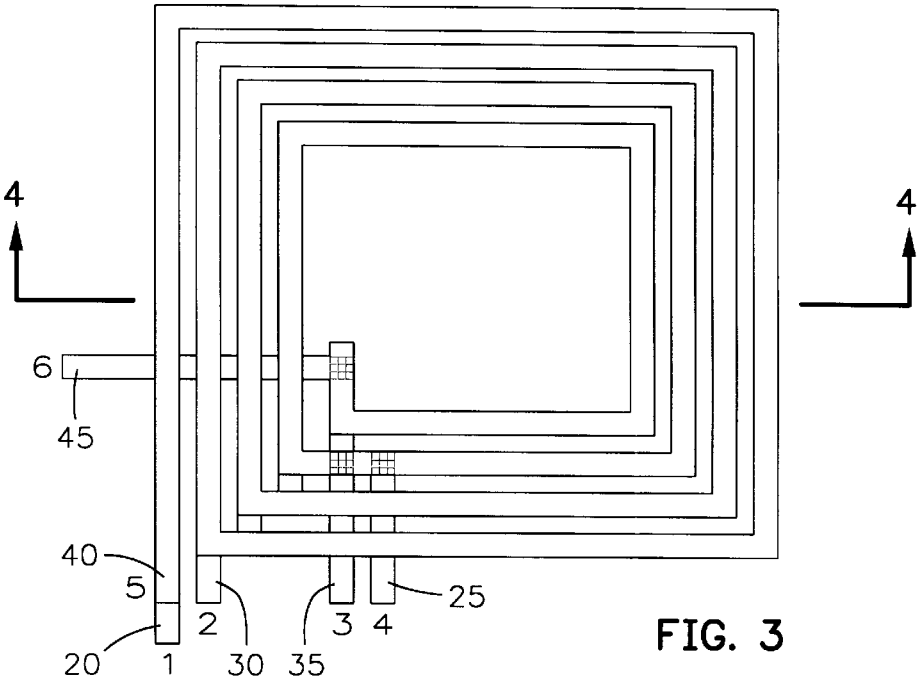
FIG. 3 is a layout plot illustrating how the patterns of the metallic inductor layers shown in FIGS. 2A and 2B are aligned to form a transformer.
Figure 3A:
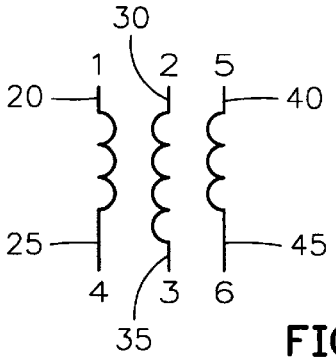
FIG. 3A is a schematic diagram of the transformer of FIG. 3.

When viewed in plan from above the surface 18 of the substrate material layer 12 (FIG. 1) the substantial alignment of the patterns of the first and second metallic inductors 16 and 17 is shown in FIG. 3. FIG. 3A is an electrical schematic of the transformer that is formed by the first and second metallic inductors 16 and 17.

Figure 4:
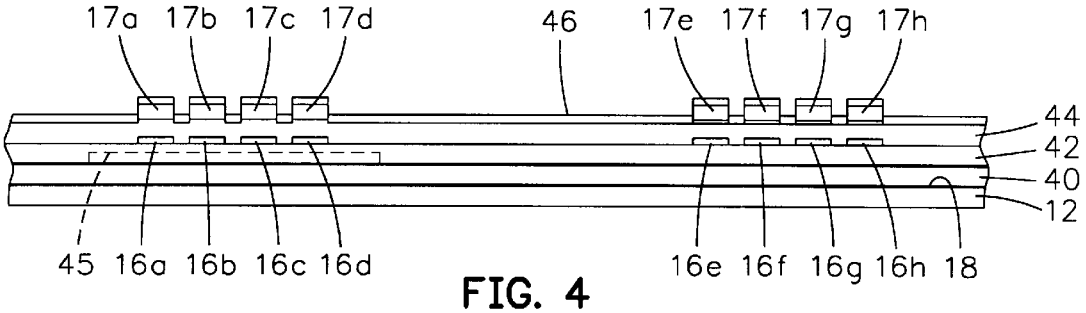
FIG. 4 is a side sectional elevation drawing of an integrated circuit including the transformer represented by the layout plot of FIG. 3.

FIG. 4 shows a partial side section of the integrated circuit structure that includes the volume element 10 shown in FIG. 1 and the first and second metallic inductors laid in the patterns illustrated in FIGS. 2A, 2B and 3. In FIG. 4, the substrate material layer 12 includes the upper surface 18 on which various layers that make up the volume portion 14 are monolithically fabricated. Additional layers 400, 420, 440, and 460 are shown in FIG. 4 for illustration only, with the understanding that the IC in which this invention is illustrated would include more layers between and over those shown in FIG. 4. FIG. 4 is for the purpose of illustrating vertical relationships between the elements of the transformer comprising the first and second metallic inductors 16 and 17. In this regard, the metal layers previously described are disposed, in ascending order with respect to the surface 18, as follows: metal 1, metal 2, metal 3. Further, these metal layers are substantially parallel. The location of the metal 1 layer that contains the conductive strips 25, 35 and 45 is coplanar with the material layer 420, as indicated by the phantom projection of the conductive strip 45. Metal 2, the metal layer in which the first metallic inductor 16 is formed, is coplanar with material layer 44 as indicated by the sections 16*a*–16*h* of the first metallic inductor 16. Finally, metal 3, the material layer that includes the second metallic inductor 17 is disposed over metal 2, with the pattern of the second metallic inductor 17 in alignment with the pattern of the first metallic inductor 16. The vertical location of metal 3 with respect to metal 2 and metal 1 is indicated by the portions 17*a*–17*h* of the second metallic inductor.

Figure 5:
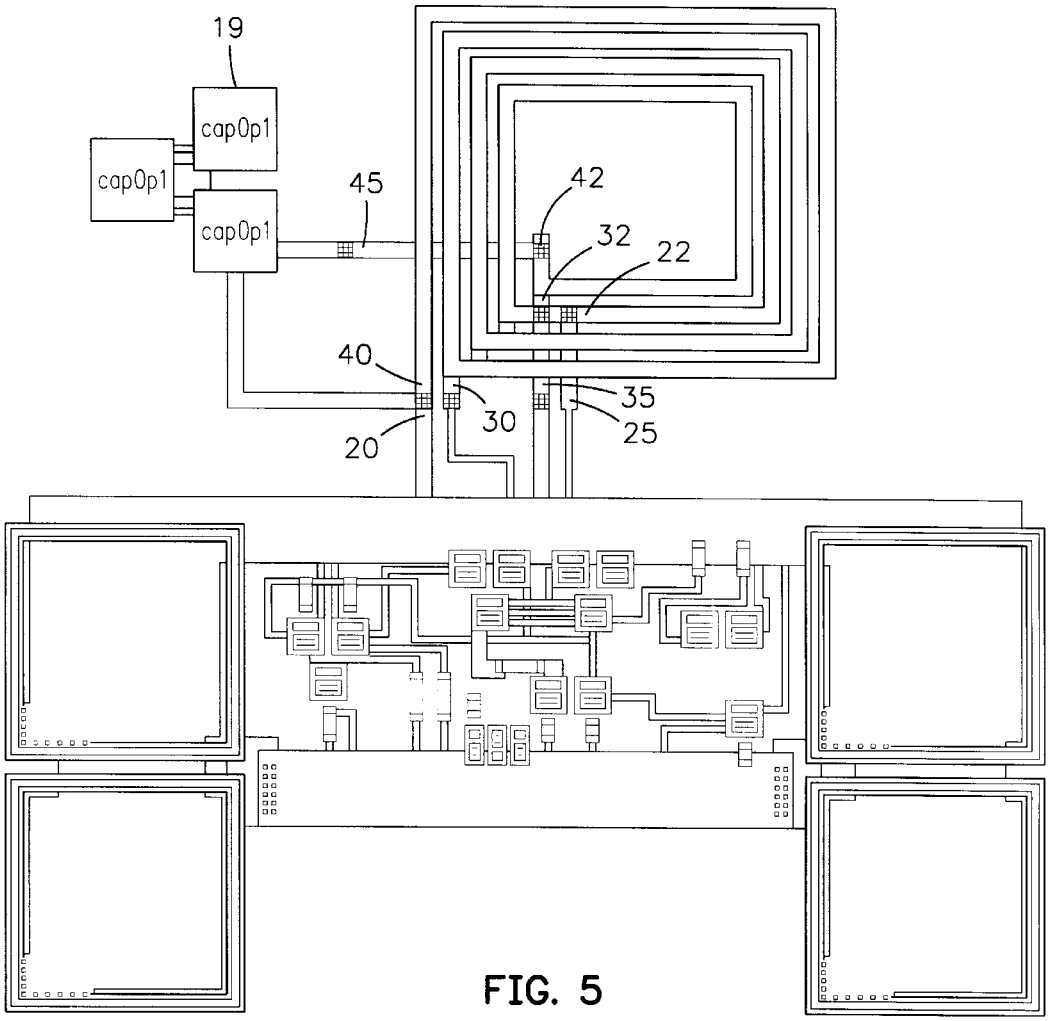
FIG. 5 is a plot of an IC layout for the fabrication of a voltage controlled oscillator (VCO) circuit whose schematic is illustrated in FIG. 6 and that includes the transformer of FIGS. 3 and 3A.
Figure 6:
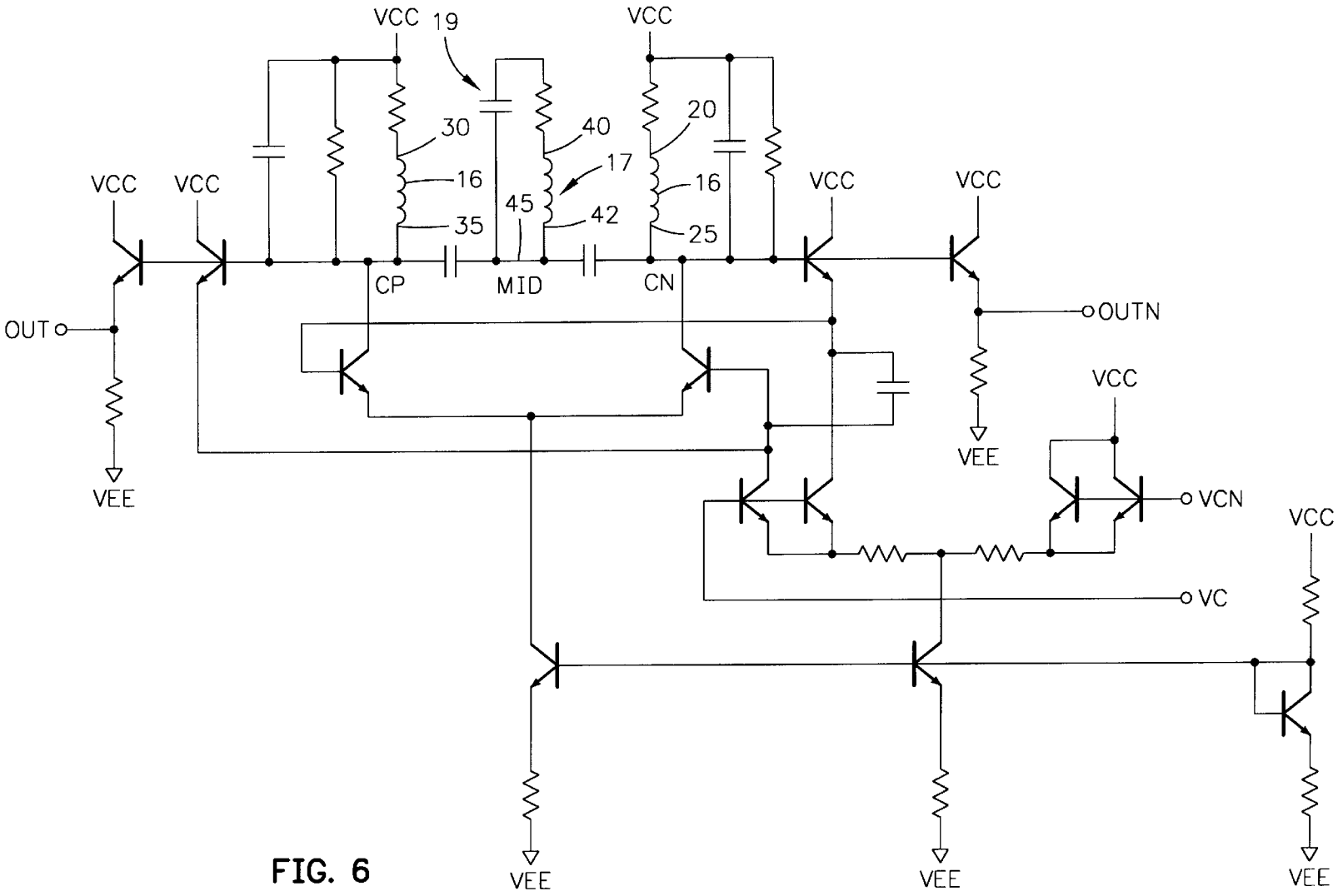

When fabricated with the structures and relationships illustrated in FIGS. 1–4. a transformer that incorporates the first and second metallic inductors 16 and 17 may be incorporated into a voltage-controlled oscillator as illustrated in FIGS. 5 and 6. FIG. 5 is a mask plot showing, in plan directed to the substrate material layer 12, how a voltage controlled oscillator (VCO) would be laid out for IC fabrication. FIG. 6 is a schematic of the VCO circuit. The operation of the VCO is set forth in detail in cross-referenced U.S. patent application Ser. No. 08/856,259. For the explanation of this invention, it can be seen with reference to FIGS. 5 and 6 that the first and second metallic inductors 16 and 17, when laid out and fabricated with the relationships and connections discussed in respective FIGS. 1–4, form respective resonant sections of the VCO, with the second metallic inductor 17 and a parallel capacitor 19 operating as a floating resonator that is driven by currents that flow through the two inductors of which the first metallic inductor 16 is comprised. As FIGS. 5 and 6 show, the terminals 20 and 30 are coupled to a Vcc bus, while the terminals 25 and 35 are connected, respectively, to respective sections of a differential amplifier, while the resonator comprising the second metallic inductor 17 and the capacitor 19 is connected at a node MID that couples to the terminals 25 and 35 through respective capacitances.

The techniques and materials necessary to fabricate an IC transformer according to the principles of this invention are known to the skilled artisan, with the observation that all of the portions of the metallic inductors would be formed from a conductive metal, such as aluminum or gold, that can be accommodated in the relevant manufacturing procedures.

While only certain preferred features of this invention have been shown by way of illustration, many changes and modifications will occur to those skilled in the art. Accordingly, it is to be understood that the appended claims are intended to cover all such modifications and changes as fall within the true spirit and scope of the invention.

I claim:

1. An integrated circuit transformer, comprising:

a semiconductor structure including a substrate and a plurality of material layers disposed over the substrate;

a first metallic inductor disposed in a first material layer;

a second metallic inductor having a pattern and disposed in a second material layer;

a third metallic inductor disposed in the first material layer; and a capacitor electronically coupled in parallel with the second metallic inductor;

the first metallic inductor being a primary coil;

the first and third metallic inductors each having the pattern of the second metallic conductor;

the patterns of the first, second, and third metallic inductors being substantially aligned with respect to each other, over a surface of the substrate.

2. The integrated circuit transformer of claim 1, wherein the patterns of the first, second and third metallic inductors are square spirals.

3. The integrated circuit transformer of claim 1, further including electronic circuit components connected to the first metallic inductor for providing a current to drive the first metallic inductor.

4. The integrated circuit transformer of claim 1, wherein the second metallic inductor is positioned over the first and third metallic inductors.

5. The integrated circuit transformer of claim 1, wherein the second material layer is disposed over the first material layer.

6. An integrated circuit with a substrate and a plurality of material layers in which circuit elements are formed, the circuit elements comprising:

one or more electronic circuits comprising said circuit elements; and a transformer in at least one of the electronic circuits, the transformer comprising:

a first metallic inductor disposed in a lower material layer; and a second metallic inductor having a pattern and disposed in an upper material layer;

a third metallic inductor disposed in the first material layer; and a capacitor electronically coupled in parallel with the second metallic inductor;

the first metallic inductor being a primary coil;

the first and third metallic inductors each having the pattern of the second metallic conductor;

the patterns of the first, second, and third metallic inductors being substantially aligned with respect to each other, over a surface of the substrate.

7. The integrated circuit of claim 6, further including electronic circuit elements connected to the first metallic inductor for providing a current to drive the first metallic inductor.

8. The integrated circuit of claim 6, wherein the patterns of the first, second and third metallic inductors are square spirals.

9. The integrated circuit of claim 6, wherein the second metallic inductor is positioned above the first and third metallic inductors.

10. The integrated circuit of claim 6, wherein the second material layer is disposed above the first material layer.

* * * * *